United States Patent [19]

Shpigelman

[11] Patent Number: 4,461,161

[45] Date of Patent: Jul. 24, 1984

[54] LOCKING DEVICE

[76] Inventor: David Shpigelman, 1 Mavo Gilath, Ramoth Zahala, Tel Aviv, Israel

[21] Appl. No.: 535,537

[22] Filed: Sep. 23, 1983

Related U.S. Application Data

[63] Continuation of Ser. No. 242,702, Mar. 11, 1981, abandoned.

[51] Int. Cl.[3] ..... E05B 27/06; E05B 35/04

[52] U.S. Cl. ..... 70/352; 70/358; 70/385; 70/386; 70/387

[58] Field of Search ..... 70/352, 348, 350, 351, 70/358, 377, 382, 384–387, DIG. 44, DIG. 75, 378, 392–393, 376, 402, 405, 409

[56] References Cited

U.S. PATENT DOCUMENTS

| | | | |
|---|---|---|---|
| 1,417,132 | 5/1922 | Barker | 70/386 |
| 1,527,336 | 2/1925 | Voda | 70/387 |
| 2,326,358 | 8/1943 | Hull | 70/385 |
| 2,388,227 | 10/1945 | Heyer | 70/387 |
| 3,093,993 | 6/1963 | Lord | 70/405 |
| 3,588,397 | 6/1971 | Ellefson | 70/387 X |
| 3,621,688 | 11/1971 | Asmar et al. | 70/352 |
| 3,722,243 | 3/1973 | Schiesterl | 70/377 X |
| 3,780,549 | 12/1973 | Schlage | 70/358 |
| 3,877,267 | 4/1975 | Harris, Jr. | 70/385 X |
| 4,111,018 | 9/1978 | Pilvet | 70/387 X |
| 4,149,394 | 4/1979 | Sornes | 70/352 |

*Primary Examiner*—Gary L. Smith
*Assistant Examiner*—Lloyd A. Gall
*Attorney, Agent, or Firm*—Toren, McGeady and Stanger

[57] ABSTRACT

A locking device which is operated by an inserted perforated card includes a bolt with rows of bores and a body within the casing of the device corresponding having bores in line with the first named bores and tumbler units located in the aligned bores and selectively displaceable by means of the inserted card.

7 Claims, 5 Drawing Figures

LOCKING DEVICE

This is a continuation, of application Ser. No. 242,702, filed Mar. 11, 1981, now abandoned.

BACKGROUND OF INVENTION

The present invention relates to a locking device which may be employed as a lock proper, i.e. directly locking a door, a drawer in a piece of furniture, or a strong box, or may serve to additionally safeguard an existing, conventional lock against being tampered with. More particularly the device forming the subject of this patent application is of the type which is operated by the insertion of a card like a small metal or plastic plate (to be referred to in this specification and the claims as "card").

FIELD OF INVENTION

Such locking devices are well known; the respective "card" is constituted by a plastic plate which is magnetised at certain portions and which when inserted into the locking device electronically acts on the components thereof. Such arrangements have several drawbacks, one being that magnetic properties of the card can easily be "erased" by passing a permanent magnet across the card, in contact with it. Further, the build up and the assembly of the known devices is highly complicated. The devices of this kind have to be connected to a source of electrical current and to a centre of data manipulation. In other words, skilled man-power is required at all stages of making, using and servicing such devices.

In contradistinction to these known devices, the locking device according to the present invention is fully mechanically operated, for which reason the above mentioned main disadvantage is absent.

SHORT SUMMARY OF INVENTION

According to the invention, the new device comprises a casing in which is slidably accommodated a bolt, and a block; shaped body overlying the bolt, the upper face of the bolt and the lower one of the block shaped body being in close contact, a number of bores being provided in the upper face of the bolt and corresponding, codirectional bores in the lower face of the block shaped body, tumbler units being located in the bores, the units being composed of a number of superposed cylindrical bodies and a pair of spheres resting on the cylindrical bodies, all the tumbler units being partly in the bores of the bolt and partly in the bores of the block shaped body, in part of the bores one of the cylindrical bodies traversing the contact plane between the bolt and block shaped body, while in the remaining bores the contact faces between two cylindrical bodies coincide with the contact faces between bolt and block shaped body, an inlet port in the shape of an elongated slot being provided on top of the block shaped body, one of the pair of spheres of each tumbler unit lying within the range of the slot.

These and further features of the invention will become clear from the following description.

BRIEF DESCRIPTION OF DRAWINGS

The invention will now be described with reference to the accompanying drawings wherein:

FIG. 3 is an elevational frontal view, while

DESCRIPTION OF PREFERRED EMBODIMENT

Figure 3:
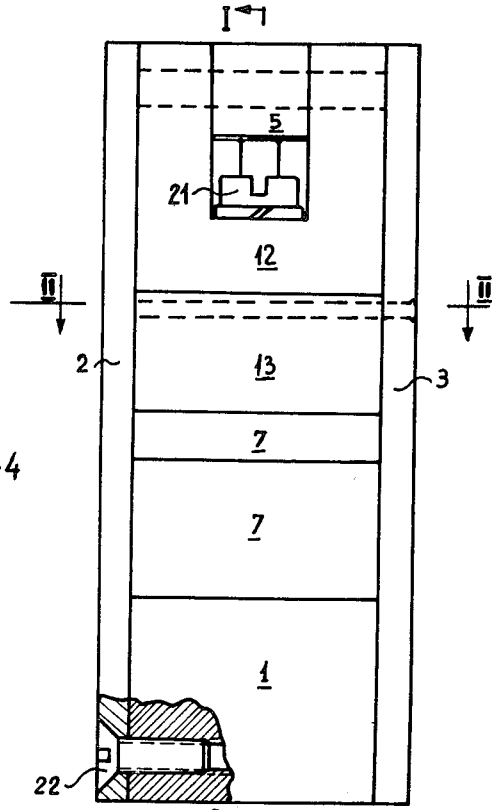

The new device comprises a casing consisting of bottom 1, two side walls (not seen in FIG. 1), 2 and 3, a rear wall 4 and a cover or lid 5 hinged on an axle 6, extending between the two walls 3 and 2.

Figure 1:
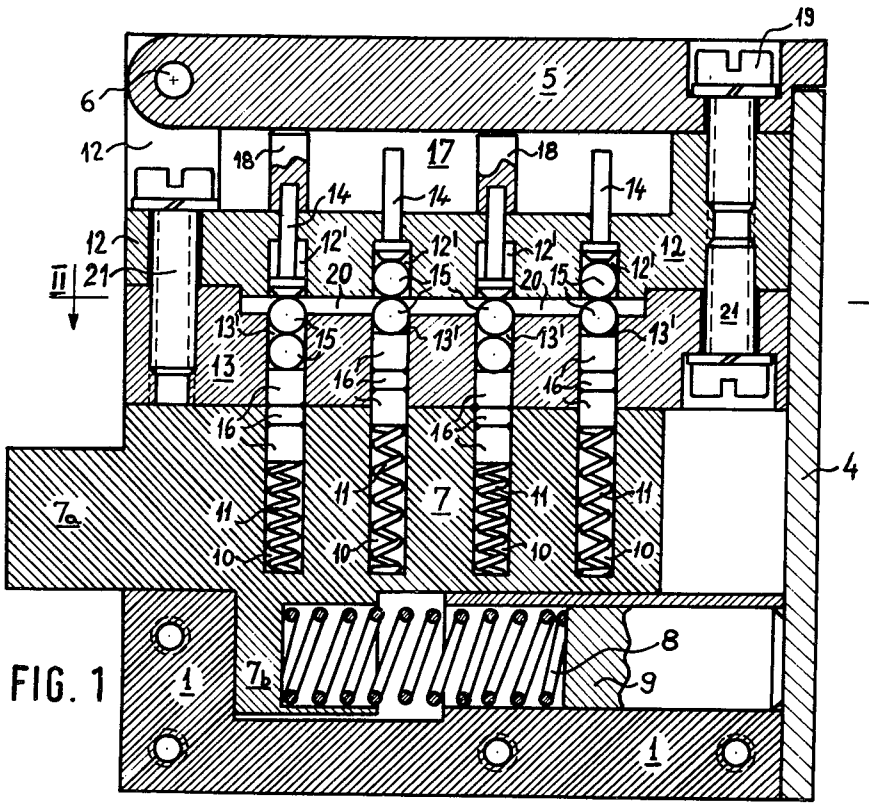
FIG. 1 is an elevational, sectional view of the new device (on line I—I of FIG. 3)
Figure 2:
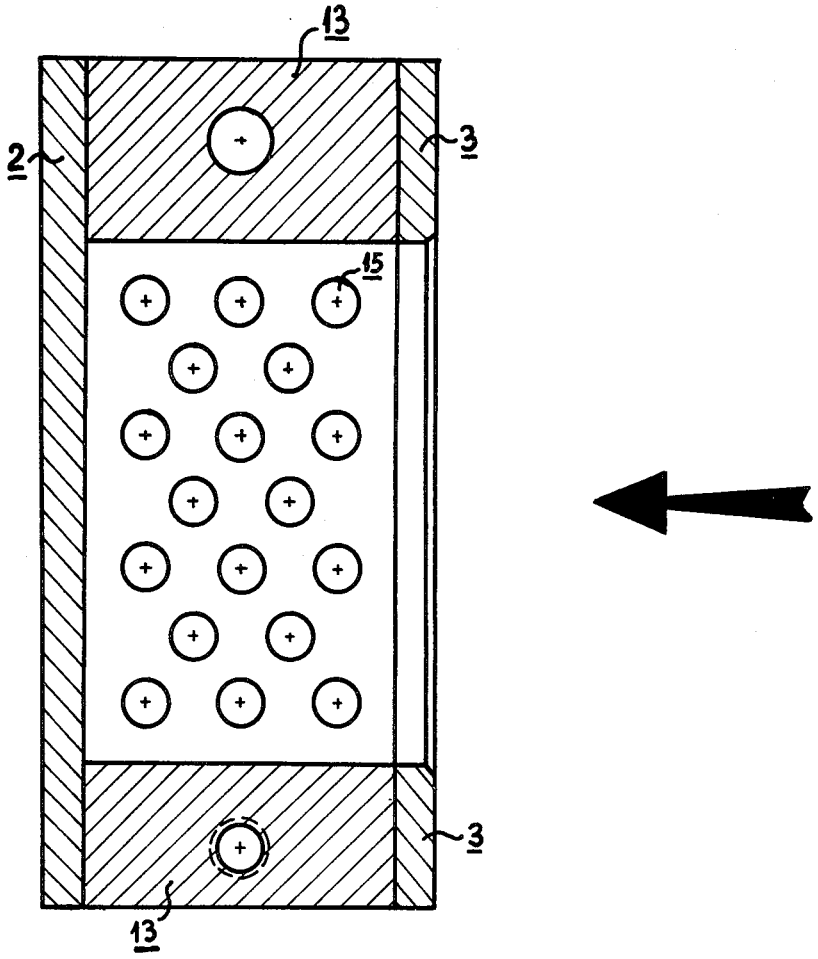
FIG. 2 being a view on line II—II of FIGS. 1 and 3.

Within the casing a locking bolt 7 having a forward tongue *7a* slides on bottom 1. The device is shown in FIG. 1 in the locking position, i.e. the bolt 7 being in its extreme forward position. It can slide inwardly (i.e. into the "open" or "unlock" position) against the urge of a spring 8 which abuts at one end against a stop *7b* extending from the lower face of bolt 7, and its other end against a stop pin or bolt 9. In the bolt 7, from its top side downwardly, extend a number of bores 10 (see FIG. 2) in which are accommodated springs 11 supporting tumbler units which will be described later. These tumbler units are accommodated in a body assembly of two parts 12, 13. These two parts are joined together by screw bolts 21 but functionally may be considered as one part. In part 13 are provided bores 13' which are in register with bores 12' in part 12 and bores 10 in bolt 7. In each of the bores 12'–13' are accommodated the tumbler units, each of which consists of a headed bolt 14, the downwardly facing head of which rests on a pair of superposed steel balls 15, the lower of which rests on three superposed cylinders 16, the middle one of which is of smaller height than the two extreme ones. The stack formed of three cylinders rests on springs 11 which urge the whole tumbler unit consisting of cylinders 16, balls 15, bolts 14 upwardly.

The upper ends of bolts 14 extend into a space 17 which is covered by the lid 5.

Some of the tumbler units, which may be chosen arbitrarily, can be subjected to a downwardly acting bias, counteracting the bias exerted by the respective spring 11. This is done by placing caps 18 on these bolts 14. By loosening a screw bolt 19 which secures lid 5, this latter may be swung upwardly, giving access to the space 17 so that the caps 18 may be positioned. When the lid 5 is swung down and secured again by screw 19, it holds down the caps 18 and presses downwardly the respective tumbler units.

Between parts 12 and 13 is created a slot 20 into which the "card" for operation of the locking device can be inserted.

This card is a stiff, square or oblong blank of a size permitting it to be fittingly inserted into slot 20 until its leading edge abuts against the wall 2. At that instant the trailing edge of the card is outside the device so that it can be withdrawn at will.

Into the card are drilled or punched holes of a diameter substantially equal to the diameter of bores 13'. The holes are located in accordance with the position of the tumbler units which had been chosen to be capped by caps 18. Generally the blank for the card would have to have as many locations for holes as there are bores 13' in the device, but only a few locations are actually perforated.

In the device illustrated by FIG. 1 it is assumed that in the row of four bores seen the first from the left and the third one have capped tumbler units. Of course in rows behind the one seen, further capped units may be present but need not be so. The card is perforated at corresponding positions.

The operation of the new locking device with the aid of a card having perforations at points which correspond with the locations of capped tumbler units, will be understood from the following.

In the position shown in FIG. 1, the device is in the "locking" position, i.e. the tongue 7*a* of the bolt 7 is presumed to be engaged, say in a recess of a door post. The bolt cannot be retracted from its position shown in FIG. 1 (thus assuming "unlocked" position), since it is held by a number of tumbler units, i.e. all units minus the capped ones. A glance at FIG. 1 shows that the tumbler units in the second and in the fourth bore from the left prevent the sliding movement of the bolt: in each case the lowermost one of the cylindrical bodies 16 is partly in the bore 10 in the bolt and partly in bore 13' in body 13, thus immobolizing the bolt. The same is the case with further tumbler units which are presumed to be located behind those seen in FIG. 1. In contradistinction to this situation, the capped units do not hold the bolt: the top face of the middle cylinder 16 (of a capped unit) is flush with the contacting faces of bolt 7 and body 13.

Assuming now that the prepared card is inserted into slot 20, it will exert pressure on the lower one of spheres 15 and cause all uncapped tumbler units successively to move downwardly against the bias of springs 11. When the leading edge of the card abuts against the far wall delimiting the slot, all tumbler units which are not capped are held down into the "open" position. While the card moves inwardly its non perforated portions act on the capped tumblers and push them down—from "open" to "locked" position—temporarily until the perforations in the card come to be in register with these capped tumblers. Now these move back into their normal "open" positions under urge of springs 11. The result: all tumbler units are in open position and the bolt can be slid inwardly of the casing by whatever conventional means.

Obviously the uncapped tumbler units can be made to move into "open" position simply by inserting a blank, i.e. non perforated plate, this however would move the capped tumbler units into locking positions.

It will be seen, therefore, that only a properly perforated card would cause the total of the tumblers to be moved into the "open" position.

It will be understood that a once chosen pattern of capped units and corresponding card can be changed by lifting lid 5 and putting the caps 18 onto different units and preparing a new card by drilling the appropriate number of holes into a blank at the chosen locations.

Figure 4:
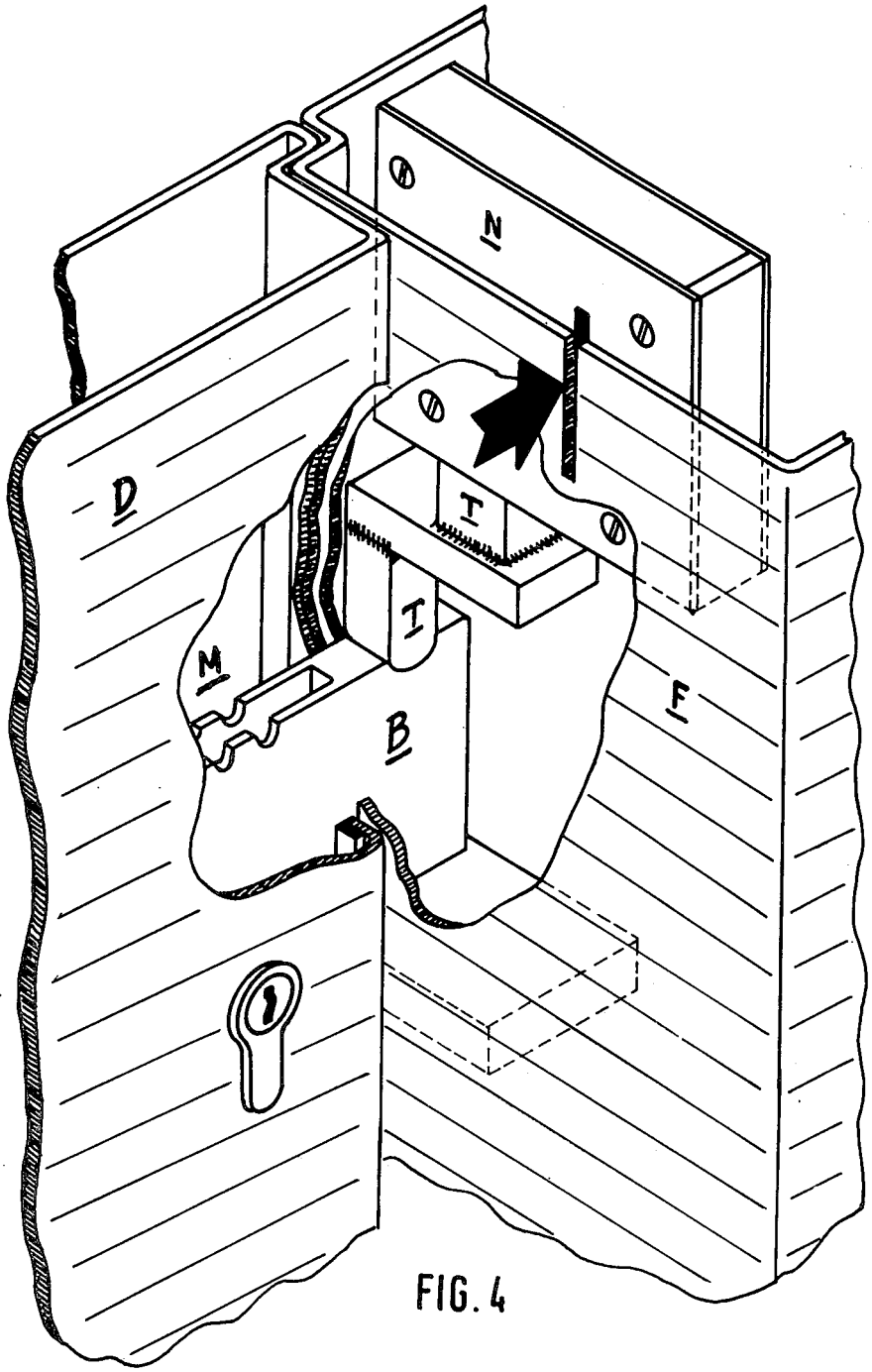
FIG. 4 illustrates by a perspective view the use of the new device in conjunction with a conventional mortise lock.

The example of FIG. 4 illustrates one possibility of using the new device. Here is shown a conventional mortise lock M seated in the usual way in a door D with the bolt B being shown in locking position. The new device is set into the door frame F. Into the bolt B a slit has been cut into which the tongue T of the new device can enter. Thus the lock M is secured and cannot be unlocked in the customary way. The device N must first be operated by means of a perforated card, tongue T freeing the bolt B for being slid into lock casing M in the conventional way by means of a key, or the door handle.

Figure 5:
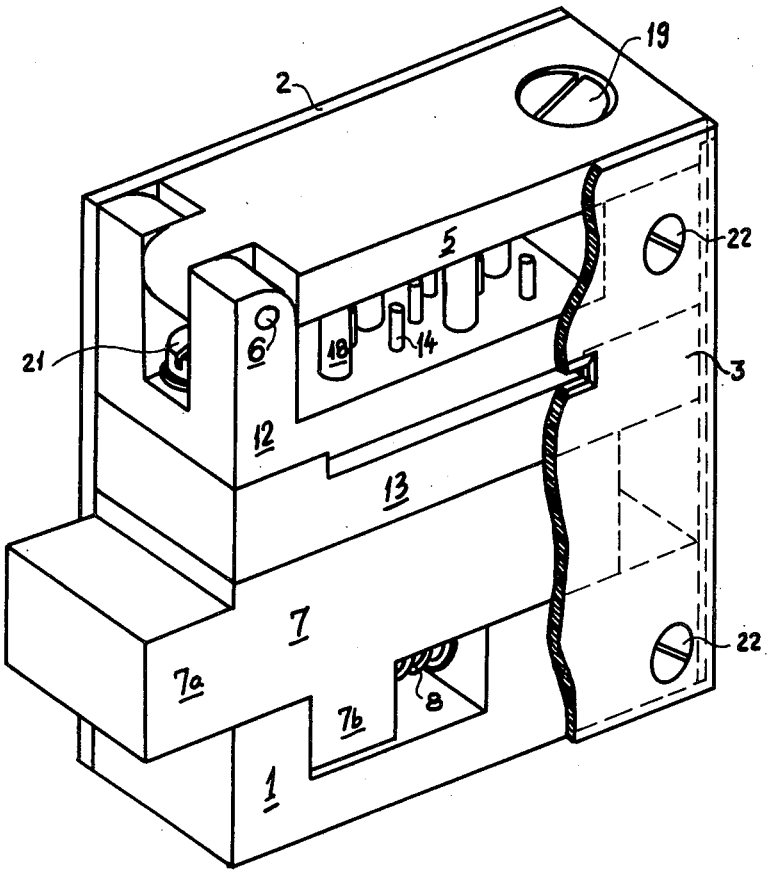
FIG. 5 is a perspective view of the new device, its casing being partly broken away.

FIG. 5, being a phantom view of the mechanism of the new device, will contribute to a better understanding of the construction. The reference numerals appearing in FIG. 5 are the same as used in connection with the figures already described. Thus no further description of FIG. 5 is deemed necessary.

In order to bring the new device back from "open" into "locking" position, the bolt 7 is slid back into closing position by the same means used for shifting it into "open" position. All that has to be done then is to withdraw the card. As a consequence, the tumblers revert to the position of FIG. 1 under the urge of the springs 11 immobolizing the bolt.

What is claimed is:

1. A locking device adapted to be operated by a punched card comprising a casing, a bolt which is slidably accommodated within said casing, and a block-shaped body located within said casing overlying said bolt, the upper face of said bolt and the lower face of said block-shaped body being in close contact, with said bolt being slidably displaceable relative to said block-shaped body, a number of bores provided in said bolt and extending downwardly from said upper face of said bolt and corresponding bores in the lower face of the block-shaped body in axial alignment with and opening to said bolt, tumbler units being located in said bores in said bolt and in said block-shaped body, said tumbler units each being formed the same and comprising three superposed cylindrical bodies and a pair of spheres located above and resting on said cylindrical bodies, the uppermost and the lowermost of which are of equal axial extension, the middle one being of smaller axial extension, each said tumbler unit located partly in one of the bores of said bolt and partly in the corresponding axially aligned bore of said block-shaped body, said tumbler units divided into a first group and a second group with the first group of said tumbler units arranged in said bores so that the lowermost of the cylindrical bodiestraverses the contact line between said bolt and block-shaped body, while the second group of said tumbler units in the remaining said bores have the contact face between the uppermost body and the middle cylindrical body coinciding with the contact faces between said bolt and block-shaped body, an inlet port in the shape of an elongated slot provided in said block-shaped body extending transversely of and intersecting said bores in said block-shaped body, said slot arranged to receive the punched card which is of a thickness equal to the axial extension of said middle cylindrical body, one of said pair of spheres of each said tumbler unit lying partly within range of said slot, and discrete means each selectively positionable within said casing above said block-shaped body and providing separate individual engagement with the second group of said tumbler units for positioning the contact face of two of said cylindrical bodies thereof so that the contact faces coincide with the contact faces between said bolt and block-shaped body.

2. The locking device claimed in claim 1, characterized therein that said means comprise auxiliary members each positionable in contact with one of said tumbler units of the second group.

3. The locking device claimed in claim 1, characterized thereby that each said tumbler unit is supported on a spring located in said bore of said bolt in which said tumbler unit is positioned, and said spring urges said tumbler unit upwardly within the respective bores in said bolt and block-shaped body.

4. The locking device claimed in claim 1, characterized thereby that a hinged lid is connected to said casing above said block-shaped body and presses downwardly against said means.

5. A locking device adapted to be operated by a punched card comprising a casing, a bolt is slidably accommodated within said casing, and a block-shaped body located within said casing overlying said bolt, the upper face of said bolt and the lower face of said block-shaped body being in close contact with said bolt being slidably displaceable relative to said block-shaped body, a number of bores provided in said bolt and extending downwardly from said upper face of said bolt and corresponding bores in the lower face of the block-shaped body in axial alignment with and opening to said bolt, tumbler units being located in said bores in said bolt and block-shaped body, said tumbler units being formed the same and comprising a number of superposed cylindrical bodies and a pair of spheres located above and resting on said cylindrical bodies, each said tumbler unit located partly in one of the bores of said bolt and partly in the corresponding axially aligned bore of said block-shaped body, said tumbler units divided into a first group and a second group with the first group of said tumbler units arranged in said bores so that one of said cylindrical bodies traverses the contact line between said bolt and block-shaped body, while the second group of said tumbler units in the remaining said bores have the contact face between two cylindrical bodies coinciding with the contact faces between said bolt and block-shaped body, an inlet port in the shape of an elongated slot provided in said block-shaped body extending transversely of and intersecting said bores in said block-shaped body, said slot arranged to receive the punched card, one of said pair of spheres of each said tumbler unit lying partly within the range of the said slot, and means selectively positionable within said casing above said block-shaped body and providing separate individual engagement with the second group of said tumbler units for positioning the contact face of two of said cylindrical bodies thereof so that the contact faces coincide with the contact faces between said bolt and block-shaped body, said means comprise auxiliary members each positionable in contact with one of said tumbler units of the second group, and each auxiliary member is cap shaped and placed in contact with the top of the uppermost end of one of said tumbler units of the second group.

6. The locking device claimed in claim 5, characterized thereby that each said tumbler unit comprises a headed bolt forming the uppermost part thereof and resting with its downwardly directed head on the upper one of said spheres.

7. The locking device claimed in claims 5 or 6, characterized thereby that each said tumbler unit is supported on a spring located in said bore of said bolt in which said tumbler unit is positioned, and said spring urges said tumbler unit upwardly within the respective bores in said bolt and block-shaped body.

* * * * *